US006711866B2

(12) United States Patent
Blount

(10) Patent No.: US 6,711,866 B2
(45) Date of Patent: Mar. 30, 2004

(54) THIN PRESTRESSED CONCRETE PANEL AND APPARATUS FOR MAKING THE SAME

(76) Inventor: Brian M. Blount, 660 SW. 83rd Ave., Portland, OR (US) 97225

( * ) Notice: Subject to any disclaimer, the term of this patent is extended or adjusted under 35 U.S.C. 154(b) by 65 days.

(21) Appl. No.: 09/947,428

(22) Filed: Sep. 5, 2001

(65) Prior Publication Data

US 2002/0059768 A1 May 23, 2002

Related U.S. Application Data

(63) Continuation-in-part of application No. 09/684,874, filed on Oct. 6, 2000.

(51) Int. Cl.[7] ..... E04H 12/00

(52) U.S. Cl. ..... 52/649.1; 52/787.1; 52/125.5; 52/251; 52/600

(58) Field of Search ..... 52/787.1, 125.5, 52/251, 600, 649.1

(56) References Cited

U.S. PATENT DOCUMENTS 3,451,181 A * 6/1969 Neuschotz ..... 52/787.1
4,203,788 A 5/1980 Clear
4,454,702 A * 6/1984 Bonilla-Lugo et al. .... 52/786.1
4,454,703 A * 6/1984 Sitzler et al. ..... 52/786.1
5,138,813 A 8/1992 Cooney et al.
5,232,646 A 8/1993 Nasvik et al.
5,404,687 A 4/1995 Blake et al.
5,440,845 A 8/1995 Tadros et al.
5,768,847 A 6/1998 Policelli

OTHER PUBLICATIONS

Reinforced Concrete, Nawy, 1996, Prentice–Hall, Third, pp. 458–459,668.*

* cited by examiner

*Primary Examiner*—Carl D. Friedman
*Assistant Examiner*—Steve Varner
(74) *Attorney, Agent, or Firm*—Klarquist Sparkman LLP

(57) ABSTRACT

A thin, prestressed concrete panel, having a thickness of about one and one-half inch thickness or less, and apparatus for making the same is disclosed. Pairs of prestressed tendons extend between the side and end portions of the panel. The tendons of each pair are positioned on each side of the mid-plane of the panel and spaced from such mid-plane so as to increase panel strength and prevent warping of the panel. A molding apparatus for casting the panel comprises a bottom plate, a pair of opposite side portions, and a pair of opposite end portions. Slots are defined in the side and end portions through which tendons are inserted prior to pouring concrete in the mold. Tensioning means are provided for prestressing the tendons in the longitudinal and lateral directions of the panel.

25 Claims, 6 Drawing Sheets

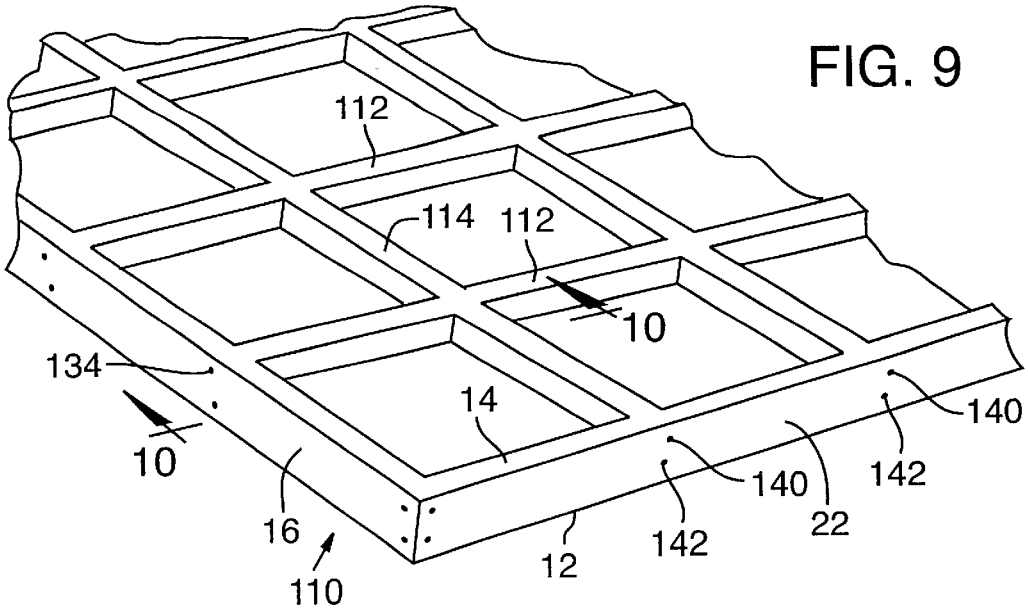
FIG. 9
FIG. 10
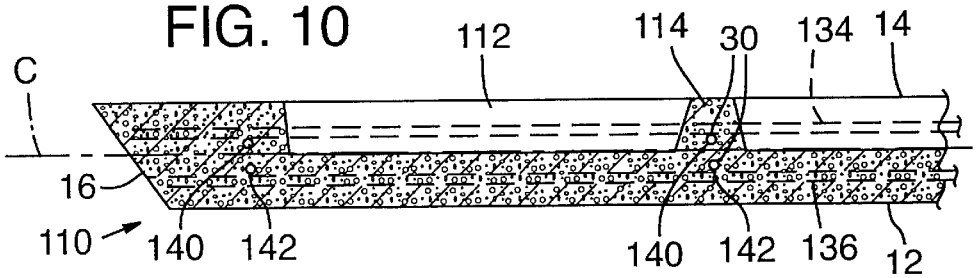
FIG. 11
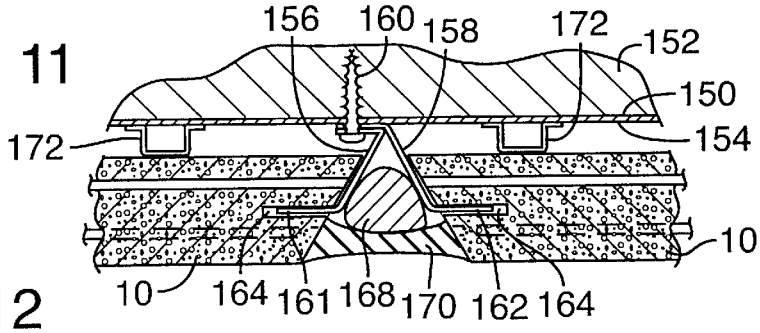
FIG. 12
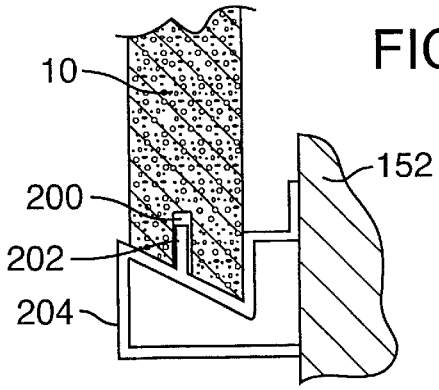
FIG. 13
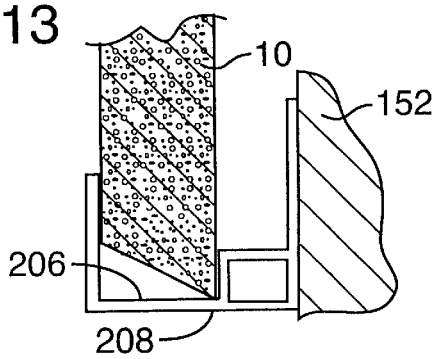

THIN PRESTRESSED CONCRETE PANEL AND APPARATUS FOR MAKING THE SAME

This is a continuation-in-part of U.S. patent application Ser. No. 09/684,874, filed Oct. 6, 2000, which is incorporated herein by reference.

THE FIELD OF INVENTION

The present invention relates to the construction and manufacture of thin prestressed concrete panels useful for architectural cladding of buildings and other purposes.

BACKGROUND OF THE INVENTION

Exterior cladding of a building is subjected to attacks from climatic conditions such as freeze-thaw cycles, moisture intrusion, ultra-violet rays, wind and seismic loading and sometimes vibration from traffic and other sources, amongst other things.

Precast concrete cladding systems have been used extensively on commercial buildings because of their durability and architectural appeal. However, precast concrete cladding, as used heretofore, is provided typically in heavy elements and its use has been limited to reinforced concrete or steel frame structures due to the load that it imposes on a building. Consequently, a building designed to carry the lateral and gravity loads imposed by the heavy concrete skin system is costly. Moreover, existing concrete panel systems are susceptible to permanent deformation from perpendicularly applied loads that create surface cracks in the tension face of the panel.

SUMMARY OF THE INVENTION

In accordance with the invention, concrete panels are prepared by casting panels of about 1.5 inch thickness or less, which contain prestressed tendons. The tendons are oppositely positioned between the mid-plane of the panel and each of the opposite faces and may be spaced either equidistantly or at different distances from the adjacent face, in spaced grids. The positioning of opposing tendons between the mid-plane and the opposite faces increases panel resilience and will effect return of a panel to its original shape after being flexurally deformed by loads imposed normal to its faces, such return being effected even if a crack has developed in the tension face of the panel.

OBJECTS OF THE INVENTION

It is, accordingly, an object of this invention to provide a prestressed concrete panel that is thin, light, durable and resilient.

Another object of the invention is to provide a prestressed concrete panel that may be field cut and easily installed on a structure.

Still another object of the invention is to provide an improved apparatus for casting prestressed concrete panels at a reduced cost.

The foregoing and other objects, features and advantages of the present invention are described further in the following detailed description, which proceeds with reference to the accompanying.

DRAWINGS

FIG. 9 is a fragmentary view of a panel having a ribbed construction to provide a higher strength to weight ratio.

FIG. 10 is a fragmentary sectional view taken along line 10—10 of FIG. 9 showing tendon placement.

FIG. 11 is a fragmentary sectional view showing one arrangement for securing panels of the invention to a building surface.

FIG. 12 is a fragmentary sectional view of a different mounting arrangement.

FIG. 13 is a fragmentary sectional view of still another mounting arrangement.

DETAILED DESCRIPTION

Figure 2:
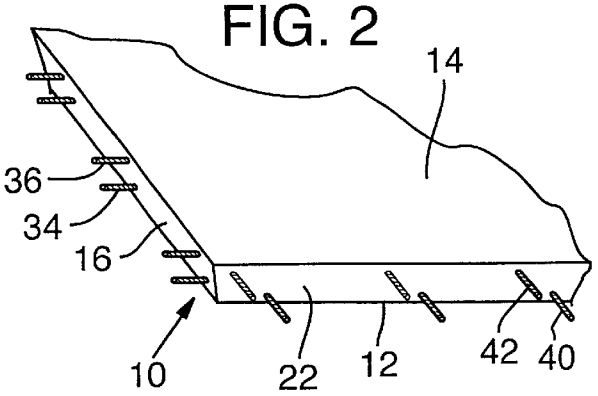
FIG. 2 is a fragmentary perspective view of a panel made in accordance with the invention.
Figure 1:
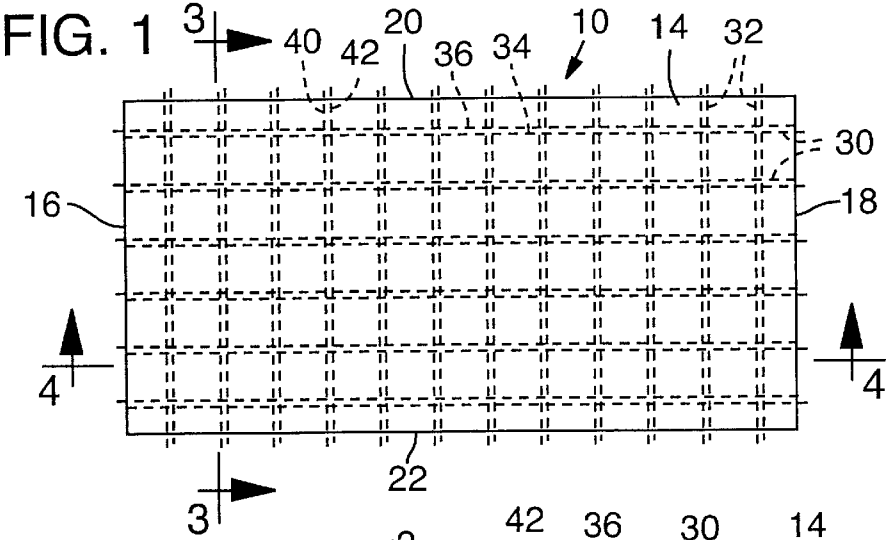
FIG. 1 is a plan view of the tendon layout in a panel made in accordance with the invention.

Referring first to FIGS. 1–4, there is therein illustrated a preferred embodiment of the invention comprising a thin prestressed, reinforced concrete panel 10, which may be, for example, approximately 50 inches in length, 25 inches in width and have a ⅝ inch thickness. This size is only illustrative since the panel may be made in a wide variety of sizes. A thin panel as used herein refers to a panel with a maximum thickness of approximately 1.5 inches.

The illustrated panel 10 is formed with an exposed face 12 and an opposite back face 14 each of which faces are flat and parallel to one another. Alternatively, the exposed face 12 may be textured rather than flat to achieve a desired architectural appearance on the panel. Panel 10 is shown as formed with a pair of opposite end faces, or edges, 16, 18, and a pair of opposite side faces, or edges, 20, 22. In the illustrated embodiment the side and end faces are beveled such that the back face 14 is of larger dimensions in length and breadth than the exposed face 12. Such beveled faces are advantageous in that the exposed face 12 of the panel is less likely to chip during handling than is a panel having exposed and back faces that are perpendicular to the side and end faces. It therefore should be appreciated that the likelihood of chipping occurring is reduced as the angle between the exposed face 12 and an end or side face is increased. The beveled faces also facilitate removal of a cast panel from the mold in which it is formed.

Extending through the panel 10 between the end faces 16, 18 is a set of prestressed, parallel tendons, which may comprise a plurality of longitudinally extending pairs 30 of stainless steel wire ropes. Similarly, a second set of tendons is provided extending between the side faces 20, 22 which also may comprise a plurality of pairs 32 of pre-tensioned stainless steel wire ropes.

Figure 4:
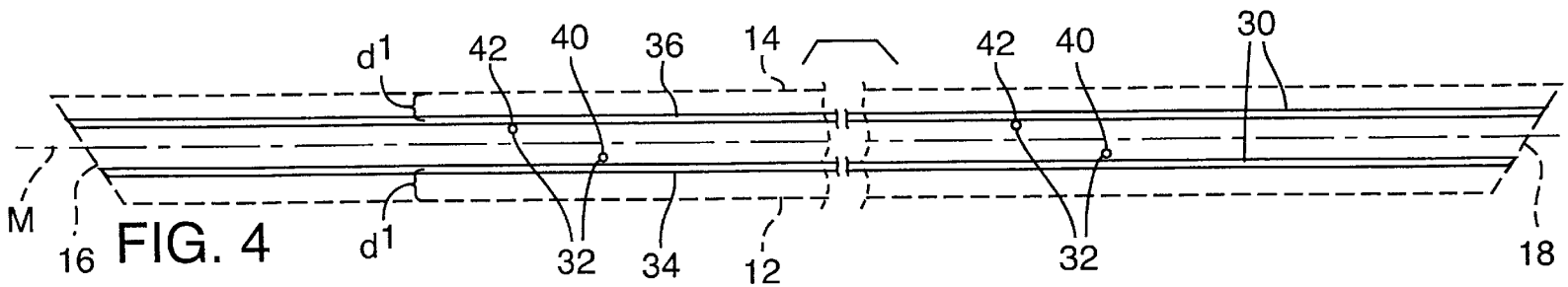
FIG. 4 is a sectional view taken along line 4—4 of FIG. 1.

Referring more particularly to FIG. 4, each of the tendon pairs 30 comprises a first wire rope 34 which is spaced a distance $d^1$ (as measured to its center line) from the exposed face 12 and a second wire rope 36 which is positioned the identical distance $d^1$ from the back face 14. The distance $d^1$ is preferably approximately equal to two times the diameter of the wire ropes, which in the case of a ⅝ inch thick panel, are preferably 1/16 inch diameter, 7×7 strand stainless steel wire rope. In thicker panels the wire ropes, or tendons, may have a diameter up to approximately ⅛ inch. Such rope configuration facilitates formation of a secure bond between the concrete and the rope, and the positioning of the ropes no less than two diameters from the adjacent face will assure that no bond failure will result in the event of extreme loading upon the panel. The ropes 34, 36 of each pair 30 are spaced apart laterally, i.e., relative to the side faces 20, 22. In a ⅝ inch panel a lateral spacing of about ½ inch is preferred. In thicker panels the lateral spacing between such ropes, or tendons, may be 1 inch or greater.

Figure 3:
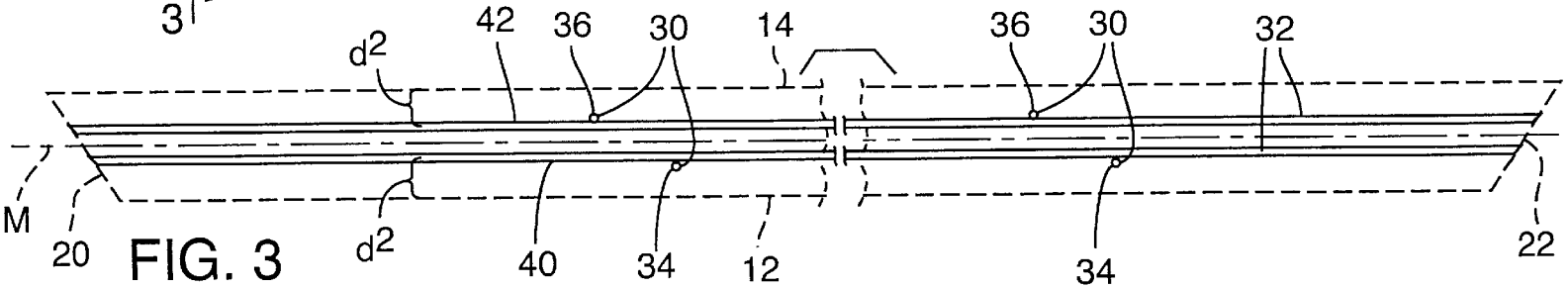
FIG. 3 is a sectional view taken along line 3—3 of FIG. 1.

As best shown in FIG. 3, pairs 32 of wire ropes extend laterally with respect to the panel between the side faces 20, 22. Each pair 32 comprises a first rope 40 and a second rope 42. The first rope 40 of each pair 32 is positioned from the exposed face 12 by a distance $d^2$ which is greater than the distance $d^1$ by a distance equal to the diameter of the ropes so that the ropes 40 extend in a straight line from side face 20 to side face 22 and tangentially contact the ropes 34. Similarly, the second ropes 42 are positioned from the back face 14 of the panel by the distance $d^2$ such that the ropes 42 tangentially contact the ropes 36.

Prestressing of the wire ropes during the casting process should be limited so that the wire ropes do not excessively relax and lose their prestress over time. In the case of a ⅝ inch thick panel using 7×7, 1/16 inch diameter stainless steel wire ropes, a satisfactory panel is obtained by prestressing the wire ropes to 315 lbs., which is approximately 70 percent of their breaking strength. This will result in a prestress in the panel of about 250 psi both longitudinally and crosswise of the panel.

The positioning of the prestressed tendons equidistantly from and on opposite sides of the mid-plane M of the panels, rather than in the mid-plane, greatly increases the panel's loading capacity and its resilience. A panel constructed as described with a minimum prestress of 200 psi on the tendons, should return to its original flat shape after being flexurally deformed even to the extent that a crack forms in the tension face of the panel. The tendons on the opposite sides of the mid-plane M of the panel may be spaced equidistantly therefrom so as to avoid an eccentric load which could cause warping of the panel. In the forming of the panel the surface textures and finishes should be accounted for in the positioning of the tendons.

Figure 16:
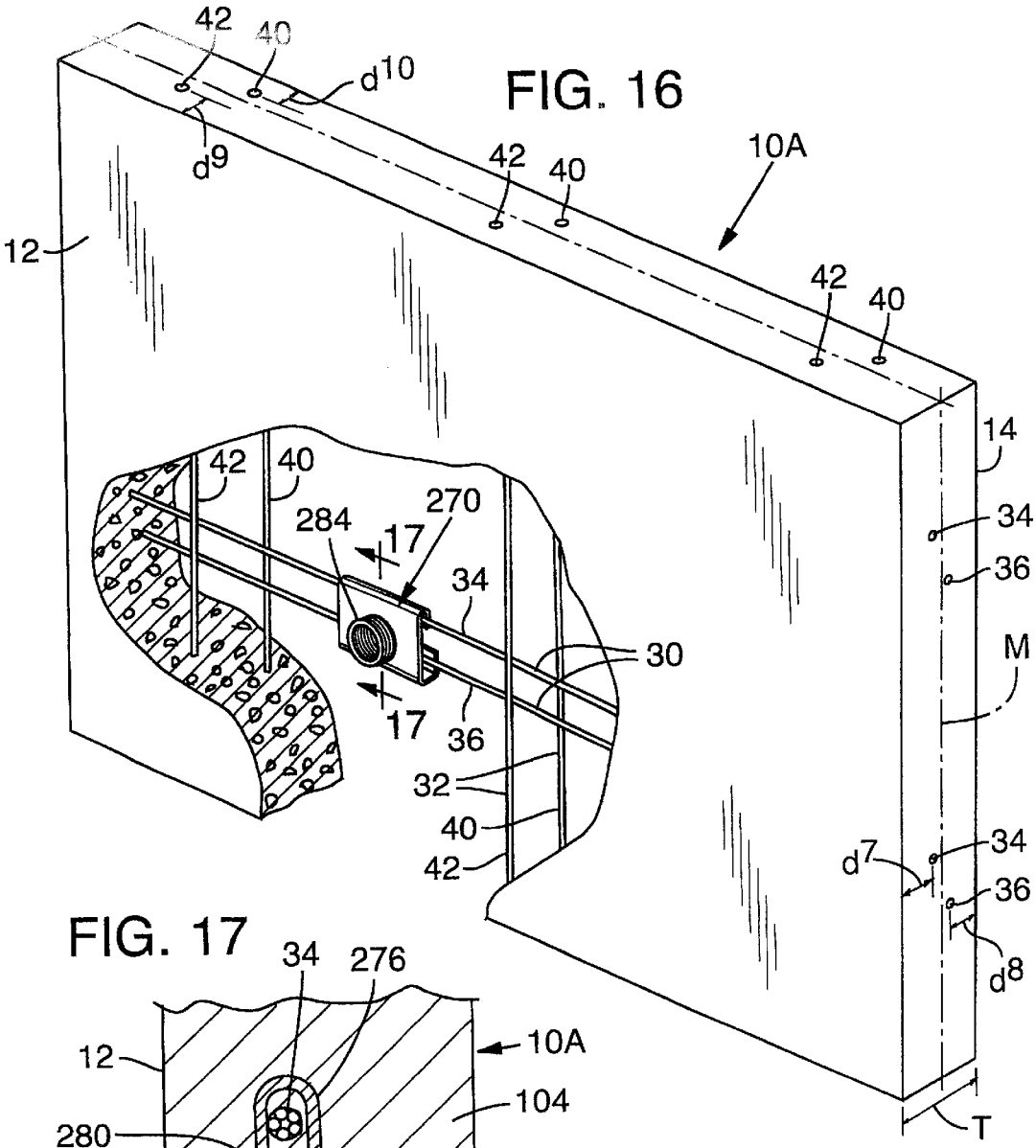
FIG. 16 is a perspective view of a portion of a panel with another form of connector.

Referring to FIG. 16, another embodiment of a thin prestressed reinforced concrete panel 10A is illustrated. This panel may have a thickness T of about one inch between its opposed faces 12 and 14. Mid-plane M is indicated intermediate faces 12, 14. As mentioned previously thin panels according to the invention may have thicknesses up to about 1.5 inches.

In this embodiment tendon pairs 30 again are denoted having a first wire rope 34 and a second wire rope 36. Tendon pairs 32 include a first wire rope 40 and a second wire rope 42.

In this embodiment although the wire ropes, or tendons, in each pair are disposed on opposite sides of mid-plane M, between the mid-plane and their associated face of the panel, their spacing relative to their associated face of the panel, and relative to the mid-plane, are not equidistant.

By way of example, and for a specific application which may require compensating prestressing forces in the panel, the distance $d^7$ between tendons, or ropes, 34 and face 12 of the one inch thick panel may be about 0.4844 inch. Distance $d^8$ between wire rope, or tendon, 36 from its associated panel surface 14 may be on the order of 0.3281 inch. The distance $d^9$ between wire rope, or tendon, 42 and its adjacent surface 12 of the panel may be on the order of 0.3906 inch, and the distance $d^{10}$ between wire rope, or tendon, 40 and its associated face 14 of the panel may be on the order of 0.2344 inch. From this it will be seen that tendons 34, 36 in one set and 40, 42 in a second set are positioned at different, unequal, distances from the mid-plane M.

Depending on concrete mix characteristics and methods of pouring and vibrating the concrete, the concrete density may not be uniform throughout the thickness of the panel and the panel may bow or warp under prestress. To compensate for the variable density of the concrete and ensure that the panel does not bow or warp, the resultant force of the tendons should be slightly offset from the mid-plane of the panel. The amount of offset from the mid-plane can be determined by trial and error or calculated with standard engineering principles for a homogeneous material once a prototype panel has been constructed and warping is measured.

Explaining further, in pouring a panel such as that indicated at 10A face 14 may be at the bottom of the mold (i.e., adjacent plate 60 of the mold as described below) and face 12 may be directed upwardly. In such process the panel may have a greater density near face 14, than near face 12.

To compensate for such varying density the tendons, as in FIG. 16, are offset toward face 14, rather than being equidistant from the mid-plane. Typically, the centerline between a pair of tendons may be offset from the mid-plane toward face 14 by a distance of a much as 10 percent of the total thickness of the panel.

Also, the tendons of each pair, while it is desirable they be close to one another laterally, should not be positioned in the same plane normal to the surfaces of the panel but should be offset therefrom to avoid creating a weak plane in the concrete. In addition, minimizing spacing between pairs of tendons increases the resilience and strength of the panel. Thus, the pairs of tendons should be spaced close enough together such that a reinforcing grid is created to disperse point loads and reinforce corners and edges of the panel. A maximum spacing of eight times the panel thickness between each pair of tendons is preferred.

For panels which are exposed to moist atmospheres, it is desirable that the tendons be non-corrosive. In place of stainless steel wire rope, carbon fiber tendons or glass fiber tendons or others could be used. In any event, a tendon must have a surface suitable for forming a firm bond between the tendon and the concrete. The tendon material should also be strong enough to limit relaxation over time so as not to lose the prestress applied thereto. High strength stainless steel of approximately 200 ksi has proved to be satisfactory.

The concrete mix utilized should be one that will have durability under the climatic conditions to which the panel will be exposed such as freeze/thaw cycles, and should be resistant to shrinkage so that prestress will not be lost and the panel's architectural appearance will be maintained. To optimize the properties of the concrete, the aggregate size preferably should not exceed one-third the panel thickness and the concrete mix should have a low water-cement ratio. A mixture of aggregates can be used to provide the desired architectural look.

Depending on the coarseness of the concrete mix, it may be difficult to obtain a flat back face 14 on a panel. In such a case, a layer of sand and cement backing mix, which preferably should be between 1/16 and 1/8 inch in thickness, may be applied to the casting form to provide a back face and achieve a flat surface. Tables 1 and 2 below detail a suitable concrete mix and a backing mix which I have found to form suitable panels.

TABLE 1

Concrete Mix

| Materials | Brand | Percent of Total by Weight | Specific Gravity |
|---|---|---|---|
| White cement | Riverside | 18.0% | 3.15 |
| Silica Fume | Master Builders | 0.0% | 2.2 |
| | Rheomac SF100 | | |
| Total Cementitious Material | | | |
| Fine silica Sand #70 | | 10.0% | 2.273 |
| Silica sand #30 | | 10.0% | 2.346 |
| Silica sand #8 | | 10.0% | 2.353 |
| 3/16" Black basalt | | 14.0% | 2.700 |
| No. 2 Crushed Granite (1/4 inch) | | 30.6% | 2.514 |
| Water | | 7.2% | 1 |
| Color | Davis 860—black | 0.09% | |
| High range super plastizier | Master Builders Rheobuild 3000 FC | 3.080 | OZ/100 lbs cement |
| Entrained Air | Master Builders MB AE 90 | 1.030 | OZ/100 lbs cement |
| Water/Cement ratio | Including Silica Fume | 40.0% | |
| Water/Cement ratio | W/O Silica Fume | 40.0% | |
| Total Wgt | | 100.0% | |
| Mix unit wgt | | 144.4 lb/cuft | |

TABLE 2

Backing Mix (when required for leveling of back face)

| Materials | Brand | Percent of Total by Weight | Specific Gravity |
|---|---|---|---|
| White cement | | 24.5% | 3.15 |
| Silica Fume | | 0.0% | 2.2 |
| Total Cement | | 24.5% | |
| Fine silica sand #70 | | 21.0% | 2.273 |
| Silica sand #30 | | 21.0% | 2.346 |
| Silica sand #8 | | 21.5% | 2.353 |
| Water | | 12.0% | 1.000 |
| High range super plastizier | Master Builders Rheobuild 3000 FC | 3.4 | OZ/100 lbs cement |
| Entrained Air | Master Builders MB AB 90 | | OZ/100 lbs cement |
| Water/Cement ratio | w/o fume | 49.0% | |
| Total Wgt | | 100.0% | |

Figure 5:
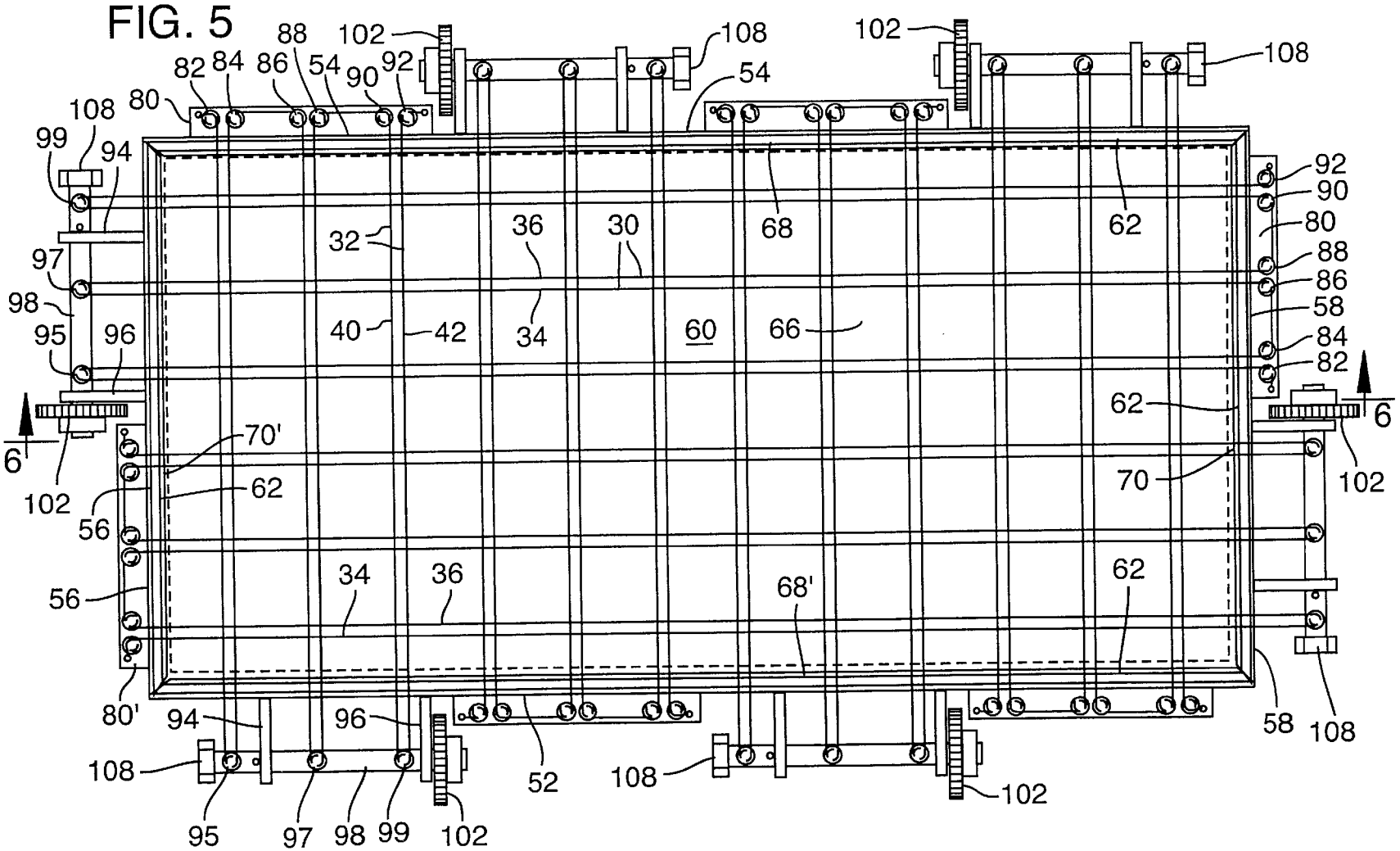
FIG. 5 is a plan view of a molding apparatus for forming a panel in accordance with the invention showing the position of the reinforcing tendons prior to the addition of concrete to the apparatus.
Figure 6:
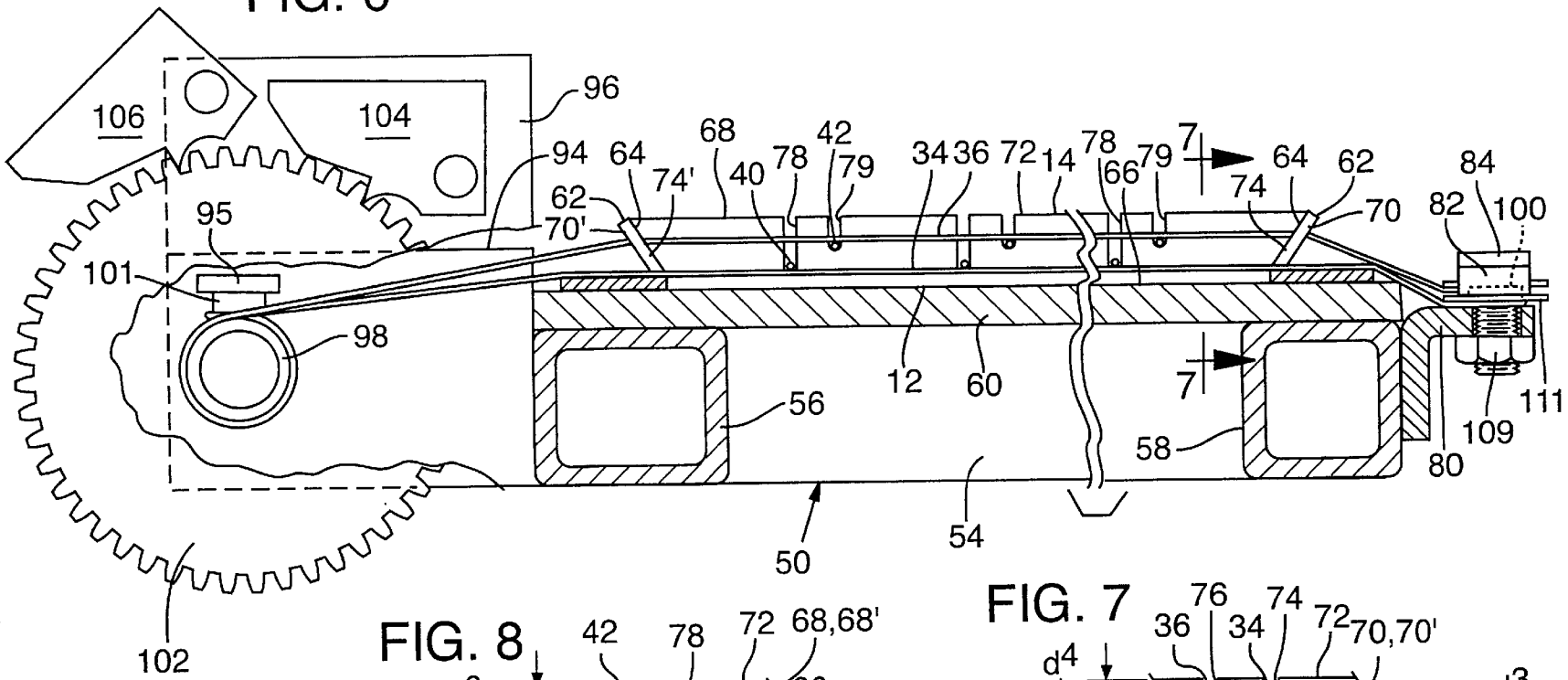
FIG. 6 is an enlarged, fragmentary sectional view of the apparatus taken along line 6—6 of FIG. 5.

Referring now to FIGS. 5 and 6, therein is shown an example of a suitable molding apparatus for forming a panel containing prestressed wire rope in accordance with the invention. The illustrated apparatus comprises a frame 50, comprising opposite longitudinal side members 52, 54 and end members 56, 58. A preferred embodiment of the molding apparatus is provided with a frame dimensioned to cast a panel measuring approximately 50 inches in length, 25 inches in width and 5/8 inch in thickness. Alternatively, larger panels, which may be, for example, of 15 feet or more in length, 6 feet or more in width, 1.5 inches thick may be cast and field cut into smaller usable panels. The frame may be reinforced with suitable bracing (not shown) to maintain the rigidity of the frame members 52–58 as tension is applied to the wire ropes.

Suitably supported on the frame 50 is the bottom plate 60 of a mold. The upper surface 66 of the plate 60 may be flat and smooth or may be textured so as to form a desired texture on the cast panel. A continuous bulkhead 62 comprising opposite side portions 68, 68' and opposite end portions 70, 70' is mounted to the sides and ends of the plate 60 and will define the side faces and end faces, respectively, of the panel cast therein.

As best shown in FIG. 6, the top edge 72 of the bulkhead defines a plane parallel to the upper surface 66 of the plate 60 and is spaced therefrom by a distance equal to the desired thickness of the panel 10. In the embodiment shown, the bulkhead 62 is formed so that the casting surface 64 thereof slopes upwardly from the upper surface 66 of the plate 60 at an included angle of about 105 degrees. The inclined casting surface 64 is desirable in that it forms the beveled side and end faces of the panel and facilitates the removal of the panel from the mold once the concrete has cured. It should be appreciated, however, that mold walls of a different inclination or walls that are perpendicular to the bottom plate could be utilized in the present invention. In any case, a mold release material is preferably applied to the upper plate surface 66 and the bulkhead casting surface 64 to assist in removing the panel once the concrete has cured.

Figure 7:
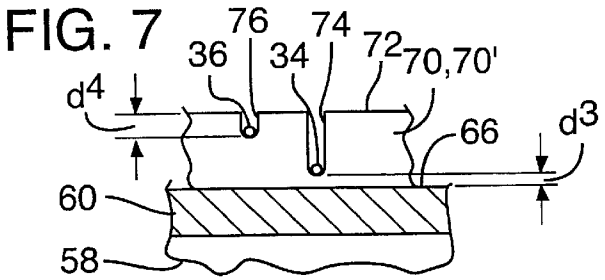
FIG. 7 is a fragmentary sectional view taken along line 7—7 of FIG. 6 showing the arrangement for positioning a pair of the tendons which extend lengthwise of the mold.

As best shown in FIG. 7, the bulkhead end portions 70, 70' are each provided with a plurality of pairs of slots 74, 76 through which the ropes 34 and 36, respectively, can be threaded prior to pouring the concrete into the mold. The bottoms of the slots 74 are each spaced from the plane of the bottom plate upper surface 66 by a distance $d^3$, which is equal to one and a half times the diameter of the ropes. The bottoms of the slots 76 are each spaced from the plane defined by the top edge 72 by a distance $d^4$, which is equal to two and a half times the diameter of the ropes. This spacing will position the ropes supported thereby equidistantly from the adjacent face of the cast panel and equidistantly from the mid-plane M of the cast panel, see FIGS. 3 and 4.

Figure 8:
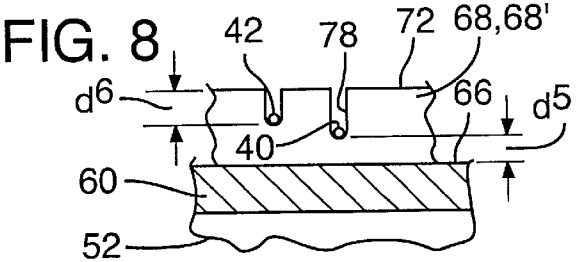
FIG. 8 is a view similar to FIG. 7 showing the arrangement for positioning a pair of tendons extending transversely of the mold.

Referring to FIG. 8, slots 78, 79 are similarly formed in the side portions 68 to properly position the wire ropes 40, 42, respectively, that extend laterally with respect to the mold. The bottoms of slots 78 are each spaced from the plane of the upper surface 66 by a distance $d^5$, which is equal to two and one half times the diameter of the ropes, and the bottoms of slots 79 are each spaced from the plane defined by the top edge 72 by a distance $d^6$, which is three and a half times the diameter of the ropes. Thus, the depths of the slots 78, 79 are such that the wires 40 will be positioned above the wires 34 in tangential engagement therewith, and the wires 42 will be positioned beneath the wires 36 in tangential engagement therewith, as best shown in FIG. 6.

The above-noted dimensioning and positioning of the slots for receiving and holding the wire ropes during the panel forming process would be modified as needed to properly position the wire ropes, or tendons, for different panels, such as described above in regard to FIG. 16.

Tensioning means are provided for applying tension to the wire ropes during the casting and hardening of the panel. Referring more particularly to FIGS. 5, 6 and 7, the illustrated tensioning devices are each arranged to apply tension to a set of three pairs of wire ropes. Since the tensioning devices are substantially identical, only the devices for a single set of wire ropes will be described in detail. Suitably mounted to the frame element 58, as by welding, is a dead head 80 into which are threaded three pairs of bolts 82, 84; 86, 88; and 90, 92, which define posts around which a wire rope is reeved as more particularly described hereinafter. A bushing 100 (indicated in dotted lines in FIG. 6) is disposed on each of the posts 84, 86, 88 and 90 to facilitate movement of the wire rope around the posts with minimal friction.

Attached, as by welding, to the opposite frame element 56 is a pair of brackets 94 and 96 in which is journaled a shaft 98. Secured to the shaft 98 are three posts 95, 97, and 99, around which a tension element is reeved. Each post 95, 97, and 99 has a bushing 101 to minimize the sliding friction of the wire rope as it is tensioned. Secured to one end of the shaft 98 is a stressing drum 102, which is adapted to be releasably engaged by a pair of ratchets 104, 106, pivotally mounted to the bracket 96. The opposite end of the shaft 98 is formed with a hex head 108 adapted to be engaged by a torque wrench (not shown) for effecting rotation of the shaft when tension is to be applied to the wire rope engaged thereon.

Referring more particularly to FIG. 5, in the embodiment shown it is convenient first to position in place the wire ropes forming the laterally extending pairs 32 and thereafter the wire ropes forming the longitudinally extending pairs 30. Thus, one end of a rope is secured to a post 82, of a side mounted dead head by tightening a nut 109 on the bottom end of the post 82 so that the rope end is securely held between the upper surface of the dead head 80 and a washer 111 disposed on the upper end portion of the post. The rope is then laid in a notch 78 of the adjacent bulkhead side portion 68 and transversely of the mold and into the opposing notch 78 in the opposite side portion 68', thus forming the first course 40 of one of the pairs 32 of tendons. The rope is carried around the post 95 and thence laced back across the mold positioning it in the notches 79, 79' adjacent the notches 78, 78' in which the first course 40 was positioned, thereby forming the course 42. It is then passed around the posts 84 and 86 as shown in FIG. 5, and back again to the opposite side of the mold, positioning the rope in the notch 78 adjacent the post 86, and the similar notch positioned opposite thereto adjacent post 97. The rope is then passed around post 97 and back across the mold positioning it in the notches 79, around the posts 88 and 90; thence back across the mold and around the post 99, and finally back to post 92 to which it is secured in a conventional manner. In similar fashion three additional wire ropes are laid laterally of the mold, between the other deadheads 80 and stressing drums 102 along the mold sides.

Thereafter the wire ropes extending lengthwise of the mold can be laid in place so as to provide the pairs 30 of ropes 34, and 36. Deadheads and stressing drums, as described above, are mounted to the frame and side members, as may be seen in FIG. 5. Two ropes in the illustrated embodiment are reeved around the posts in the deadheads and stressing drums, but in this instance the portion of a rope forming the course 34 of a set is passed under the previously stretched ropes 40 and a rope forming a course 36 is passed over the ropes 42, as best seen in FIGS. 3 and 4. As previously mentioned, the rope courses 34, 36 extend through slots 74, 76, and 74', 76', formed in the end portions 70, 70', respectively, of the bulkhead 62, the slots being dimensioned so that when the ropes are stressed and taut the longitudinal and lateral runs of the rope are tangential to one another in their straight and stressed condition.

When all of the ropes are in place, and the proper tension applied thereto, a concrete mix of desired composition may be poured into the mold. If desired, a texturing composition or element may be applied upon the upper surface 66 of the bottom plate 60 prior to mounting the ropes in place. The concrete is preferably poured into the mold from a vibrating hopper (not shown) that is moved across the mold evenly to distribute the concrete to the desired level. The mold may be mechanically vibrated to further ensure even distribution of the concrete in the mold and to effect release of entrapped air. Preferably, the top surface of the concrete is leveled with a vibrating screed (not shown) which can be drawn across the edges 72 of the bulkheads 62. If necessary or desired, a sand and cement backing mix can be applied to the top surface to fill any voids and assist in creating a flat surface. Since a panel tends to warp if moisture is allowed to escape from one of the surfaces of the panel and not the other, the upper surface of the panel in the mold is preferably covered with a wet mat during the initial curing of the concrete.

Once the initial set of the concrete has been accomplished, which will occur in approximately two hours with the mix described in Table 1 above, the mold and the concrete panel therein are preferably steam cured at 120–140° Fahrenheit for about 18 hours until the panel has developed sufficient strength (approximately 3,000 psi) to anchor the cables therein to hold their prestress. It should be appreciated that the actual time required for setting and curing of any particular panel will vary depending on panel thickness and concrete mix. When the panel has developed sufficient strength, the tension on the ropes is released by cutting the exposed tension elements extending through the bulkhead 62 with wire cutters or a similar device. The panel is then removed from the mold which may be facilitated by introducing compressed air between the casting surface and the panel. As previously mentioned, the inclined mold casting surface 64 facilitates the removal of the cast panel from the mold.

If desired, the panel may be allowed to continue to cure in a moist environment for an appropriate time, usually about five days, after being removed from the mold. Additional curing is desirable in that it increases the panel's resistance to shrinkage and its ability to maintain prestress. After curing of the panel is completed, an appropriate finish can be formed thereon by sandblasting or otherwise, and a sealer may be applied to the panel surfaces.

Referring now to FIGS. 9 and 10, there is illustrated a panel 110 constructed with a ribbed configuration with tension elements extending therethrough. The ribbed construction is advantageous in that it provides a higher strength to weight ratio than a flat faced panel. As will be apparent to those skilled in the art, the panel 110 will be cast in a mold having a waffle iron type of configuration, so that the cast panel when inverted will appear as shown in FIG. 9. The panel 110 has tendons extending through longitudinal ribs 112 and lateral ribs 114. Again, the tendons are preferably stainless steel wire rope, but can be of any other suitable material giving consideration to the environment in which the panel will be utilized. Extending through each of the longitudinal ribs 112 is a first wire rope 134 and a second wire rope 136 that is in this case, positioned vertically beneath the rope 134. The wire ropes 134, 136 are preferably positioned substantially equidistantly from the centroidal plane C of the panel, i.e. a plane through the centeroid of the panel and parallel to the flat face 12. It is desired that the forces exerted by the stressed tendons be centered in such plane and field experience with a particular panel configuration may require that particular tendons in a panel be relocated closer to or further from the centeroidal plane to achieve such force centering and avoid warping of a panel. Extending through each of the lateral ribs 114 is a wire rope 140 and a wire rope 142 positioned vertically therebeneath. Wire ropes 140, 142 are positioned so that each rope 140 is beneath and tangential to the uppermost wire ropes 134, and each wire rope 142 is immediately above and tangential to the lowermost wire ropes 136. The spacing of wire ropes in each pair at equal distances from the centroidal plane C of the panel ensures the panel does not bow or warp and effects return of the panel to its original shape after being deformed by perpendicularly applied loads.

As discussed previously, various characteristics of the panel may warrant offsetting of the tendons toward one face of the panel, such as they are not equidistant from the mid-plane. This occurs with a panel such as that described in relation to FIGS. 9 and 10 also.

Referring now to FIG. 11, there is therein shown an arrangement for securing a pair of panels made in accordance with the invention to the surface 150 of a building wall 152. A vapor barrier 154 may be placed against the surface 150 and the panels secured in position by means of clips 156, 158 held by screws 160, or other suitable fastener to the wall 150 of the building 152. The clips 156, 158 are each formed with legs 161, 162, respectively, which are adapted to be received in kerfs 164 formed by a suitable masonry saw in the end walls of the panels. A backing rod 168 may be positioned between the legs 161, 162 to provide a surface on which a sealant 170 can be applied for sealing the adjacent ends of the panels from the elements. Spacers 172 may be positioned between the surface 150 and the panels to allow for air circulation behind the panels.

Figure 14:
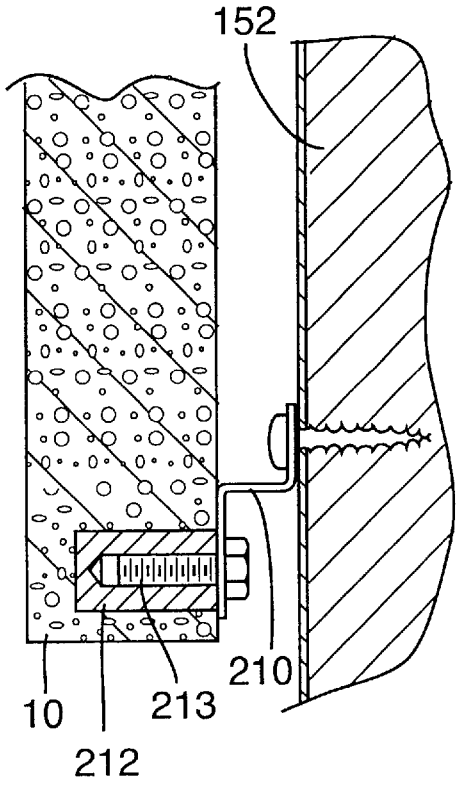
FIG. 14 is a fragmentary sectional view of an arrangement for mounting a panel utilizing an imbedded plug receiving a threaded bolt.

FIG. 12 shows still another clip arrangement that could be utilized to secure a panel 10 in which a kerf 200 is formed in an end wall thereof to receive a rib 202 provided on a clip 204, and FIG. 13 illustrates still another arrangement in which a panel 10 can be seated within a channel 206 formed in a clip 208 suitably secured to a building wall 152. FIG. 14 illustrates a still further fastening arrangement utilizing a clip 210 and an imbedded plug 212 for receiving a securing bolt 213.

Figure 15:
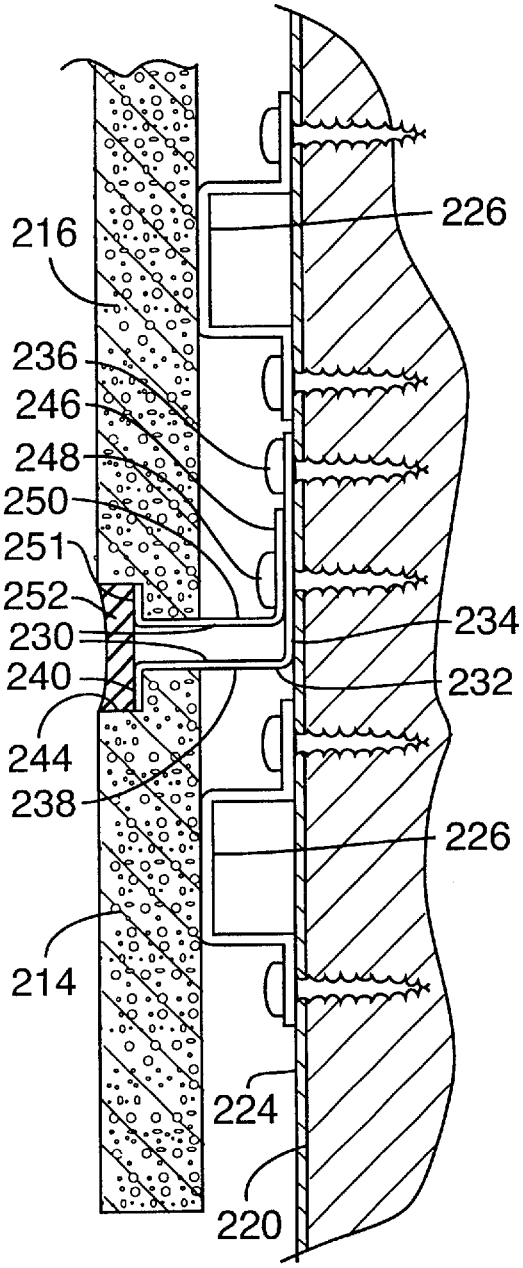
FIG. 15 is a fragmentary sectional view of an arrangement for securing thin panels to a building surface.

FIG. 15 discloses an arrangement particularly useful for securing an adjacent pair of thin panels 214, 216, i.e. panels less than three-fourths inch in thickness, to a building surface 220. With such arrangements a conventional vapor barrier 224 is suitably secured to the building surface 220 and thereafter spacers such as hat channels 226 secured in place. Precast panels are then mounted by means of two part anchor clips 230 comprising a first part 232 having a base leg 234 which is secured to the building surface by a screw 236 or the like, an outstanding leg 238 and a flange 240 adapted to seat in a step 244 formed in an edge of the panel 214. The other part of the clips comprises a base leg 246 secured to the base leg 234 and the building by a screw 248, an outstanding leg 250 and a flange 251 which fits in a step 244 formed in the adjacent edge of the panel 216. A sealant 252 may be applied over the flanges 240, 251 and the opening between the clip parts and panel edges to provide a weather tight seal.

Figure 17:
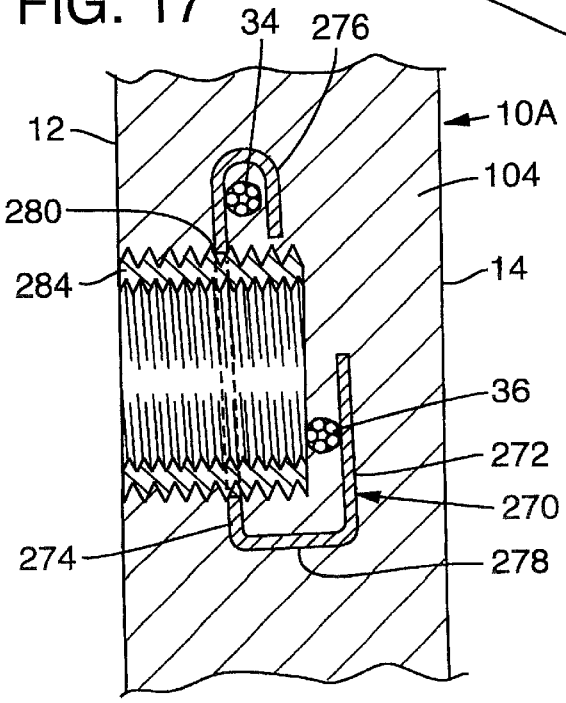
FIG. 17 is an enlarged view taken generally along the line 17—17 in FIG. 16.

FIGS. 16 and 17 illustrate another connector arrangement, indicated generally at 270, for connecting a panel to adjacent support structure. Connector 270 includes a formed sheet metal clip 272 having a substantially planar central portion 274, a return bend portion 276 adjacent one side thereof, and a reverse bend portion 278 adjacent an opposite side thereof. A circular opening 280 extends through main portion 274. Member 272 is adapted to be connected to an adjacent pair of wire ropes, or tendons, as indicated generally at 34, 36 in FIGS. 16 and 17.

The connector 270 also includes a screw plug 284. The screw plug has external threads thereon permitting it to be screwed into opening 280. The screw plug also is internally threaded for receiving a screw connector to secure the panel to an adjacent support structure.

In the process of forming a panel the clip 272 is connected to wire ropes, or tendons, such as those indicated at 34, 36, and screw plug 284 is screwed into opening 280. The screw plug is screwed into member 272 to a position in which its inner end engages wire rope 36 to clamp the connector securely to rope 36. The panel concrete then is cast about the connector. The connector thus is embedded in the panel and is adapted to receive a screw connector. Other fastening arrangements will be obvious to those skilled in the art.

In addition to using panels made in accordance with the invention as wall panels, the panels could be utilized as floor covering, counter tops, lightweight traffic surfaces on structures and other surfacing environments.

Having illustrated and described the preferred embodiments of my invention, it should be apparent to those skilled in the art that the invention permits of numerous modifications and changes in arrangement and detail. I claim all such modifications and changes as come within this scope and purview of the appended claims.

What is claimed is:

1. A thin, reinforced concrete panel comprising substantially a rectangular body of concrete having a first face and an opposite second face, said faces being flat and parallel to one another; a pair of opposite side edges; and a pair of opposite end edges, a first set of prestressed, parallel tendons extending through said body between said opposite end edges and perpendicularly to said end edges, a second set of prestressed, parallel tendons extending through said body between said opposite side edges and perpendicularly to said side edges, all of said tendons being of substantially the same diameter, said first set of tendons comprising a plurality of pairs of tendons, each of said pairs of said first set comprising a first tendon and a second tendon, said first tendons being spaced a first predetermined distance from said first face of said body, said second tendons being spaced said first predetermined distance from said second face of said body, said first predetermined distance being less than one half the distance between said faces, said first and second tendons of each pair being offset laterally from one another, said second set of tendons comprising a plurality of pairs of tendons, each of said pairs of said second set comprising a third tendon and a fourth tendon, said third tendon being spaced a second predetermined distance from said first face of said body, said fourth tendon being spaced said second predetermined distance from said second face of said body, said third and fourth tendons of each pair being offset laterally from one another, said second predetermined distance being greater than said first predetermined distance by an amount substantially equal to the said diameter of said tendons, the pairs of tendons of said first set being spaced substantially equidistantly from each adjacent pair, the pairs of tendons of said second set being spaced substantially equidistantly from each adjacent pair, and each of said tendons being pretensioned to substantially the same tension.

2. A concrete panel as set forth in claim 1, wherein said first face and second face are spaced apart a distance no greater than 1.5 inches.

3. A concrete panel as set forth in claim 2, wherein said tendons have a diameter no greater than ⅛ inch.

4. A concrete panel as set forth in claim 1 wherein said first face and said second face are spaced apart a distance no greater than one inch.

5. A concrete panel as set forth in claim 4 wherein said tendons have a diameter no greater than 5⁄64 inch.

6. A concrete panel as set forth in claim 1 where in the tendons in said panel have a prestress sufficient to produce a prestress of about 250 psi in each direction in said body of concrete.

7. A concrete panel as set forth in claim 1 wherein said tendons are wire ropes of substantially circular cross-section having a diameter no greater than about 1⁄10 the distance between said first and second faces.

8. A concrete panel as set forth in claim 7 wherein each said first wire rope is spaced from said first face a distance no less than twice the diameter of said first wire rope.

9. A concrete panel as set forth in claim 7 where in each said second wire rope is spaced from said second face a distance no less than twice the diameter of said second wire rope.

10. A thin, reinforced concrete panel comprising a rectangular body of concrete having a first face and an opposite second face, a pair of opposite side edges and a pair of opposite end edges, the body having a first cross sectional area defined by the first and second faces and the opposite side edges and having a center of area defining a first centroidal plane extending between the side and end edges, a plurality of pairs of tendons extending through said body between the opposite side edges and positioned so that one of said tendons of each pair is spaced a first predetermined distance from the first centroidal plane proximate the first face and the other said tendons of each pair is spaced said first predetermined distance from the first centroidal plane proximate the second face, the body has a second cross sectional area defined by the first and second faces and the end edges and having a center of area defining a second centroidal plane extending between the end edges and perpendicular to and co-planar with the first centroidal plane, and a plurality of pairs of tendons extending through said body between the opposite end edges and positioned so that one said tendon of each pair is spaced a second predetermined distance from the second centroidal axis proximate the first face and the other said tendon of each pair is spaced said second predetermined distance from the second centroidal axis proximate the second face.

11. The concrete panel as set forth in claim 10 wherein all of said tendons are of the same diameter and the second predetermined distance is greater than the first predetermined distance by an amount substantially equal to the diameter of said tension elements.

12. A thin, reinforced concrete panel comprising a rectangular body of concrete having a first face and an opposite second face, a pair of opposite side edges and a pair of opposite end edges, the body having a first cross sectional area defined by the first and second faces and the opposite side edges and having a center of area defining a first centroidal plane extending between the side and end edges, and a plurality of pairs of tendons extending through said body between the opposite side edges and positioned so that one said tendons of each pair is spaced a first predetermined distance from the first centroidal plane proximate the first face and the other said tendons of each pair is spaced said first predetermined distance from the first centroidal plane proximate the second face, said first face is defined by a plurality of longitudinal and lateral ribs and intervening depressions in a waffle-like pattern and said pairs of tendons extend one pair through each of said ribs.

13. A thin reinforced concrete panel as set forth in claim 12 wherein one of said faces is defined by a waffle-like grid.

14. A thin, reinforced concrete panel comprising a substantially rectangular body of concrete having a first face and an opposite second face, a pair of opposite side edges, and a pair of opposite end edges, said first face being flat, said second face having a waffle-like configuration defined by a plurality of parallel, lateral ribs extending between said side edges and a plurality of parallel, longitudinal ribs extending between said end edges, and intervening indentations, said panel having a centroidal plane, a first set of prestressed, parallel tendons extending through said body between said opposite end edges and perpendicularly to said end edges, a second set of prestressed, parallel tendons extending through said body between said opposite side edges and perpendicularly to said side edges, said first set of tendons comprising a plurality of pairs of tendons, each of said pairs of said first set comprising a first tendon and a second tendon, said first tendons of said first set extending one through each of said longitudinal ribs and said second tendons of said first set being positioned one beneath each of said first tendons;

said first tendons of said first set being positioned a first predetermined distance from said centroidal plane, said second tendons of said first set being positioned said first predetermined distance on the side of centroidal plane opposite said first tendons, said second set of tendons comprising a plurality of pairs of tendons, each of said pairs of said second set comprising a third tendon and a fourth tendon, said third tendons extending one through each of said lateral ribs and said fourth tendons being positioned one beneath each of said third tendons, said third tendons being parallel to said plane and on the same side of said plane on said first tendons and being spaced a second predetermined distance from said centroidal plane such that said third tendons are tangential to each of said first tendons, said fourth tendons being parallel to said centroidal plane and on the same side of said plane as said second tendons and being spaced said second predetermined distance from said plane whereby said fourth tendons are tangential to each of said second tendons.

15. A thin, reinforced concrete panel comprising a substantially rectangular body of concrete having a first face and an opposite second face, said faces being flat and parallel to one another with a panel mid plane between said faces; a pair of opposite side edges; and a pair of opposite end edges, a first set of prestressed, parallel tendons extending through said body between said opposite end edges, a second set of prestressed, parallel tendons extending through said body between said opposite side, said first set of tendons comprising a plurality of pairs of tendons, each of said pairs of said first set comprising a first tendon and a second tendon, said first tendons being positioned a first distance from said mid plane and between said mid plane and said first face of said body, said second tendons being positioned a second distance from said mid plane and between said mid plane and said second face of said body, said first and second tendons of each pair being offset laterally from one another, said second set of tendons comprising a plurality of pairs of tendons, each of said pairs of said second set comprising a third tendon and a fourth tendon, said third tendon being positioned a third distance from said mid plane and between said mid plane and said first face of said body, said fourth tendon being positioned a fourth distance from said mid plane and between said mid plane and said second face of said body, said third and fourth tendons of each pair being offset laterally from one another, and each of said tendons being pretensioned to substantially the same tension.

16. The concrete panel of claim 15, wherein said first and second distances are unequal.

17. The concrete panel of claim 15, wherein said third and fourth distances are unequal.

18. The concrete panel of claim 15, wherein said first and second tendons in a pair of tendons are spaced apart and have a centerline therebetween and said centerline is offset a selected offset distance from the mid-plane toward one of said faces of the panel.

19. The concrete panel of claim 18, wherein said offset distance may be in a range up to 10% of the total thickness of the panel between said first face and said second face.

20. The concrete panel of claim 15, which further comprises connecting means for attaching said panel to an adjacent support structure.

21. The concrete panel of claim 20, wherein said connecting means comprises a groove formed in an edge of said panel adapted to receive a connecting clip attached to said support structure.

22. The concrete panel of claim 20, wherein said connecting means comprises a threaded anchor imbedded in said concrete body.

23. The concrete panel of claim 22, wherein said threaded anchor is internally threaded to receive a screw.

24. The concrete panel of claim 20, wherein said connecting means comprises a support member connected to at least one tendon to position the support member during the process of casting the concrete panel, said support member having a bore extending therethrough, the central axis of which is substantially normal to a face of said panel, and a screw plug having external threads thereon screwed into said bore with an internally threaded bore opening to the face of the panel.

25. The concrete panel of claim 24, wherein said screw plug has an outer end and said external threads permit adjustment of said screw plug in said bore to position said outer end substantially flush with said face of the panel.

* * * * *